US011319728B2

(12) United States Patent
Fullenwider et al.

(10) Patent No.: US 11,319,728 B2
(45) Date of Patent: May 3, 2022

(54) TRUE INDICATING AUTOMATED SASH LOCK

(71) Applicant: Interlock USA, Inc., Reno, NV (US)

(72) Inventors: Marc Wesley Fullenwider, Reno, NV (US); Stephen Andrew Durham, Reno, NV (US)

(73) Assignee: INTERLOCK USA, INC., Reno, NV (US)

( * ) Notice: Subject to any disclaimer, the term of this patent is extended or adjusted under 35 U.S.C. 154(b) by 248 days.

(21) Appl. No.: 16/569,184

(22) Filed: Sep. 12, 2019

(65) Prior Publication Data

US 2020/0080344 A1 Mar. 12, 2020

Related U.S. Application Data

(60) Provisional application No. 62/730,044, filed on Sep. 12, 2018.

(51) Int. Cl.
*E05B 63/20* (2006.01)
*E05B 65/08* (2006.01)
(Continued)

(52) U.S. Cl.
CPC ..... *E05B 63/205* (2013.01); *E05B 9/02* (2013.01); *E05B 41/00* (2013.01);
(Continued)

(58) Field of Classification Search
CPC ..... Y10T 292/093; Y10T 292/0886; Y10T 292/0887; Y10T 292/0889;
(Continued)

(56) References Cited

U.S. PATENT DOCUMENTS 4,063,766 A * 12/1977 Granberg ..... E05C 3/046 292/336
5,031,942 A * 7/1991 Harrod ..... E05C 1/166 292/224

(Continued)

FOREIGN PATENT DOCUMENTS

CA 2424339 A1 * 10/2004 ..... E05B 65/08
CA 2733599 A1 * 9/2011 ..... E05B 63/20

(Continued)

*Primary Examiner* — Christine M Mills
*Assistant Examiner* — Steven A Tullia
(74) *Attorney, Agent, or Firm* — DeLio Peterson & Curcio LLC; David R. Pegnataro

(57) ABSTRACT

An automated sash lock for locking a window sash comprises a linearly depressible trigger, a cam-style locking element normally biased towards a locked position, a rotatable detent actuated by the trigger, a pivotable transfer element between the detent and the locking element, and an actuator for manually operating the lock mechanism to unlock the lock when the window is in a closed and locked position. The detent is normally biased in the direction of the locking element and a portion of the detent engages a body portion of the locking element to maintain the locking element in a retracted position when the window is open. Upon actuation of the trigger by a closing window, the trigger translates linearly into the lock housing and rotates the detent into the disengaged position, pulling the detent away from the locking element and allowing the locking element to fire out of the lock housing and into an opening in a strike in the adjacent sash to prevent the sashes from relative sliding movement.

18 Claims, 11 Drawing Sheets

(51) Int. Cl.
*E05B 9/02* (2006.01)
*E05C 7/04* (2006.01)
*E05B 41/00* (2006.01)
*E05C 7/00* (2006.01)

(52) U.S. Cl.
CPC ..... *E05B 65/0835* (2013.01); *E05C 7/04* (2013.01); *E05C 2007/007* (2013.01); *E05Y 2900/148* (2013.01)

(58) Field of Classification Search
CPC ..... Y10T 292/1039; Y10T 292/10395; Y10T 292/1052; Y10T 292/1054; Y10T 292/1056; Y10T 292/106; Y10T 292/1077; Y10T 292/1078; Y10T 70/5146; Y10T 70/515; E05B 63/205; E05B 63/18; E05B 63/185; E05B 63/20; E05B 63/202; E05B 9/02; E05B 41/00; E05B 65/0835; E05B 65/08; E05B 65/0811; E05B 65/0841; E05C 7/04; E05C 2007/007; E05Y 2900/148; Y10S 292/20; Y10S 292/47; Y10S 292/26; Y10S 292/35
USPC ..... 49/449
See application file for complete search history.

(56) References Cited

U.S. PATENT DOCUMENTS 5,219,193 A * 6/1993 Piltingsrud ..... E05B 13/002 292/106
6,848,728 B2 2/2005 Rotondi et al.
6,871,885 B2 * 3/2005 Goldenberg ..... E05B 65/0841 292/14
7,017,957 B2 * 3/2006 Murphy ..... E05B 65/0835 292/241
7,591,494 B2 * 9/2009 Mitchell ..... E05B 63/185 292/336
7,665,775 B1 * 2/2010 Miller ..... E05B 63/20
8,002,317 B2 8/2011 Satram et al.
8,182,001 B2 5/2012 Tremble et al.
8,205,920 B2 * 6/2012 Flory ..... E05B 13/004 292/241
8,272,164 B2 * 9/2012 Albrecht ..... E05C 1/10 49/185
8,333,413 B2 12/2012 Bourgoin et al.
8,414,039 B2 4/2013 Liang et al.
8,657,347 B2 2/2014 Liang et al.
8,727,393 B2 5/2014 Ruspil
8,844,985 B2 * 9/2014 Liang ..... E05B 63/185 292/336
8,870,244 B2 10/2014 Liang et al.
8,899,632 B2 12/2014 Tremble et al.
9,163,437 B1 10/2015 Lawrence
9,260,893 B1 2/2016 Ruspil
9,617,765 B1 * 4/2017 Lawrence ..... E05B 63/20
2001/0005995 A1 7/2001 Subliskey
2004/0026932 A1 * 2/2004 Coleman ..... E05B 17/2003 292/241
2004/0201227 A1 * 10/2004 Smith ..... E05B 65/0864 292/241
2006/0033343 A1 * 2/2006 Xu ..... E05B 63/20 292/139
2006/0087130 A1 * 4/2006 Liang ..... E05B 15/102 292/242
2006/0244269 A1 11/2006 Rotondi
2006/0244270 A1 * 11/2006 Rotondi ..... E05B 65/0876 292/213
2007/0085350 A1 * 4/2007 Liang ..... E05B 41/00 292/240
2007/0209285 A1 9/2007 Bestler et al.
2009/0115204 A1 * 5/2009 Rycroft ..... E05C 3/043 292/341.17
2011/0221211 A1 9/2011 Weron et al.
2011/0248516 A1 10/2011 Liang et al.
2011/0271720 A1 * 11/2011 Zheng ..... E05C 3/043 292/341.17
2011/0304163 A1 * 12/2011 Liang ..... E05B 13/002 292/106
2016/0060920 A1 * 3/2016 Liang ..... E05B 65/0835 292/241

FOREIGN PATENT DOCUMENTS

DE 10063784 A1 * 6/2002 ..... E05B 63/202
EP 2873790 A1 * 5/2015 ..... E05B 65/0811
GB 2324331 B 10/1998
KR 20140048687 A * 4/2014
WO WO-2004038141 A1 * 5/2004 ..... E05B 63/20

* cited by examiner

TRUE INDICATING AUTOMATED SASH LOCK

BACKGROUND OF THE INVENTION

1. Field of the Invention

The present invention relates to a lock mechanism for a window assembly and, more particularly, to an automated sash lock for a window assembly that prevents window separation around the lock once the sash is in a locked position.

2. Description of Related Art

A double-hung, single hung, and double slider window assembly typically includes a window frame and a pair of window sashes mounted for vertical reciprocal sliding movement, one relative to the other, in guide rails of the master frame jamb of the window assembly.

A traditional lock mechanism of the prior art for a double hung window assembly usually includes one part of the lock on one sash and another part of the lock on the other sash, wherein joining the two parts of the lock mechanism together results in locking the sashes to one another.

One disadvantage of this type of lock mechanism is that it normally requires the sashes be a certain distance away from one another. When the sashes are too close to one another or too far apart the lock mechanism may be ineffective. For example, if the sashes are spaced too far apart, the two parts of the lock mechanism may not be able to be joined together and the window sashes may not be locked. If the sashes are too close to one another, the parts of the lock mechanism may bind or interfere with one another, resulting in the parts not being able to mate together and therefore the window sashes may not be locked. When these problems occur during installation, the installer must adjust the window sashes and lock mechanism, numerous times, before achieving a proper fit between the sashes and lock mechanism. These problems may also occur overtime when windows become old, warped, or damaged through normal wear and tear.

As a result of the foregoing disadvantage, the lock mechanism and/or window sashes may need to be replaced without any assurance that the problems will not reoccur. In addition, forcibly pushing the sashes together in order to bring them to a proper distance may result in stress upon the frame around the sashes and/or the glass panes. Continuing to use the lock mechanism and window sashes in this fashion can exacerbate the problems.

Therefore, a need exists for an improved window sash lock that is more flexible to use than traditional lock mechanisms.

SUMMARY OF THE INVENTION

Bearing in mind the problems and deficiencies of the prior art, it is therefore an object of the present invention to provide an improved window sash lock that automatically locks the window sashes without user intervention.

It is another object of the present invention to provide an improved window sash lock that provides a true indication of the state of the lock and can accommodate multiple lock states.

A further object of the invention is to provide an improved window sash lock that does not require additional connection methods to prevent window separation around the lock once the window is locked and provides increased resistance to forced entry.

It is yet another object of the present invention to provide an improved window sash lock which includes multiple actuation modes.

It is still yet another object of the present invention to provide an improved method of automatically locking a pair of window sashes without user intervention.

Still other objects and advantages of the invention will in part be obvious and will in part be apparent from the specification.

The above and other objects, which will be apparent to those skilled in the art, are achieved in the present invention which is directed to an automated sash lock for locking a window sash. The sash lock comprises a lock housing having a front surface and a rear surface defining first and second openings, and a locking element having a body portion and a cam portion extending from the body portion. The locking element is rotatable through the rear surface first opening about a first axis between unlocked and locked positions, and is normally biased toward the locked position. A detent is rotatably secured within the lock housing and rotatable between engaged and disengaged positions about a second axis parallel to the first axis, where the detent is engaged with the locking element body portion when in the engaged position to retain the locking element in the unlocked position, and is normally biased toward the engaged position. The sash lock further includes a depressible trigger being linearly translatable between an extended position and a retracted position within the lock housing to rotate the detent to the disengaged position, where the trigger at least partially extends through the rear surface second opening when in the extended position and is normally biased to the extended position by the detent. The trigger is caused to translate from the extended position to the retracted position as the window sash moves into a window closed position, thereby rotating the detent into the disengaged position and causing the locking element to move to the locked position, whereby the locking element cam portion engages with a strike in an adjacent window sash when in the locked position to prevent the sashes from relative sliding movement. The trigger may be linearly translatable in a direction normal to the first and second axes.

The sash lock may further include a transfer element pivotally secured within the lock housing and pivotable between first and second positions about a first end, where the transfer element includes a fin for engaging the locking element body portion to retain the locking element in an unlocked position when the transfer element is in the first position and the detent is in the disengaged position. The detent may include a recess and a resilient flange adjacent the recess, and the transfer element may be at least partially disposed within the detent recess and normally biased toward the first position by the detent resilient flange.

In an embodiment, the locking element body portion may include first and second flanges extending radially therefrom, where the transfer element fin engages the locking element second flange when the transfer element is in the first position and the locking element is in the unlocked position. The detent may also include a catch extending therefrom the detent catch being engaged with the locking element first flange when the detent is in the engaged position.

In at least one embodiment, the lock housing front surface defines an opening and the sash lock further includes an actuator engageable with the locking element body portion and translatable through the front surface opening between first, second, and third positions. The actuator being in the first position when the locking element is in the unlocked position and the detent is in the engaged position and being in the second position when the locking element is in the locked position and the detent is in the disengaged position. The actuator is manually translatable to the third position when the locking element is in the locked position and the detent is in the disengaged position to cause the locking element to rotate to the unlocked position. The locking element body portion may include a plurality of teeth extending radially therefrom and the actuator may be engageable with the locking element plurality of teeth, where the engagement between the actuator and the locking element plurality of teeth causes the locking element to rotate to the unlocked position as the actuator is manually translated to the third position.

The actuator first position may represent a window open and unlocked state, the second position may represent a window closed and locked state, and the third position may represent a window closed and unlocked state. The actuator may comprise a push rack extending through the front surface opening, and at least a portion of the actuator may be visible when the actuator is in the first, second, and third positions to indicate a state of the sash lock.

In an embodiment, the trigger may include a ramped portion for slidingly contacting an edge of the window sash as the window moves into the window closed position, whereby the window sash edge causes a cam action to translate the trigger into the retracted position. The locking element cam portion may comprise a hooked portion extending radially from the body portion for engaging with the strike in the adjacent window sash when in the locked position.

In another aspect, the present invention is directed to a method of operating a sash lock mounted with respect to window sashes capable of relative sliding movement. The method comprises providing a sash lock mounted on a first window sash, where the sash lock includes: a lock housing having a front surface and a rear surface defining first and second openings; a locking element comprising a body portion and a cam portion extending from the body portion, the locking element being rotatable through the rear surface first opening about a first axis between unlocked and locked positions, the locking element being normally biased toward the locked position; a detent rotatably secured within the lock housing and rotatable between engaged and disengaged positions about a second axis parallel to the first axis, the detent engaged with the locking element body portion when in the engaged position to retain the locking element in the unlocked position, the detent being normally biased toward the engaged position; and a depressible trigger being linearly translatable between an extended position and a retracted position within the lock housing to rotate the detent to the disengaged position, the trigger at least partially extending through the rear surface second opening when in the extended position and being normally biased to the extended position by the detent. The method further comprises providing a strike mounted on a second window sash, the strike including an opening for receiving the locking element and preventing the sashes from relative sliding movement; causing the detent to rotate to the engaged position to retain the locking element in the unlocked position; moving the first window sash with respect to the second window sash from an open position towards a closed position wherein the window sashes move relative to each other in generally parallel planes; and causing the trigger to translate from the extended position to the retracted position as the window sashes move into the closed position, thereby rotating the detent into the disengaged position and causing the locking element to rotate to the locked position, the locking element cam portion engaging with the strike opening to prevent the sashes from relative sliding movement.

The sash lock may further include a transfer element pivotally secured within the lock housing and pivotable between first and second positions about a first end, the transfer element including a fin for engaging the locking element body portion to retain the locking element in an unlocked position when the transfer element is in the first position and the detent is in the disengaged position, and an actuator engageable with the locking element body portion and translatable through an opening in the lock housing front surface between first, second, and third positions, the actuator being in the first position when the locking element is in the unlocked position and the detent is in the engaged position and being in the second position when the locking element is in the locked position and the detent is in the disengaged position, the actuator being manually translatable to the third position when the locking element is in the locked position and the detent is in the disengaged position, and the method may further comprise translating the actuator to the third position to cause the locking element to rotate to the unlocked position, engagement between the actuator and the locking element body portion causing the locking element to rotate to the unlocked position as the actuator is translated to the third position; and causing the transfer element to pivot from the second position to the first position to retain the locking element in the unlocked position.

At least a portion of the actuator may be visible when the actuator is in the first, second, and third positions to indicate a state of the sash lock, and the method may further comprise viewing a position of the actuator to determine whether the sash lock is in a locked or unlocked condition when the window sashes are in the closed position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
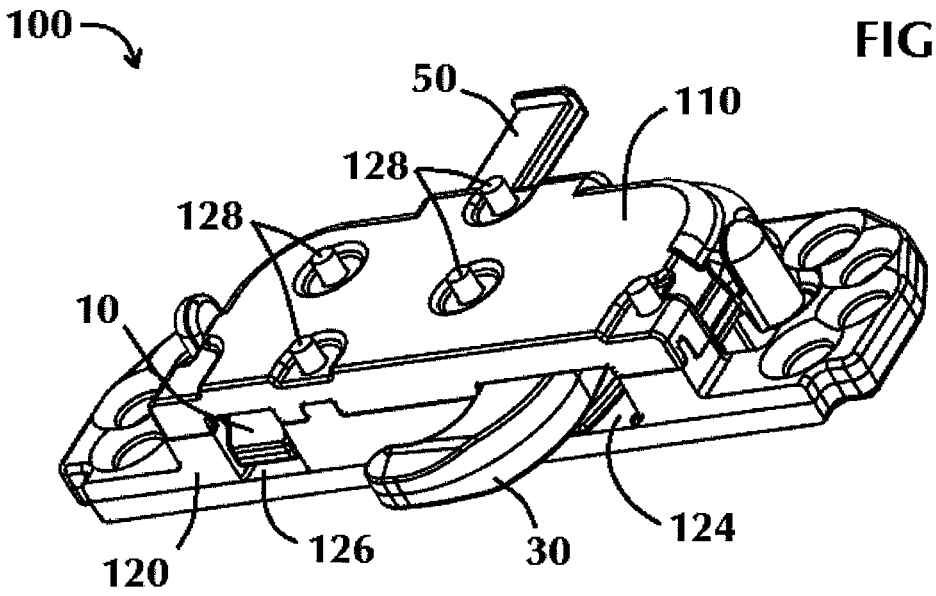
FIGS. 1 and 2 are perspective views of one embodiment of the sash lock mechanism of the present invention, in a window closed and locked position. The window sashes are not shown, for clarity.

In describing the embodiments of the present invention, reference will be made herein to FIGS. 1-19 of the drawings in which like numerals refer to like features of the invention.

The present invention is directed to an automated window sash lock comprising a linearly depressible trigger, a cam-style locking element, a rotatable detent actuated by the trigger, and a transfer element between the detent and the locking element. In one or more embodiments, the sash lock further includes an actuator, such as a pull-back pinion or push-in rack, for manually operating the lock mechanism to unlock the window after the window has been closed and locked. Multiple actuation modes permit a pull-back function that allows for traditional auto locking actuation (utilizing the trigger), and a push-in function that allows for button functioning and concealed lock function.

Certain terminology is used herein for convenience only and is not to be taken as a limitation of the invention. For example, words such as "upper," "lower," "left," "right," "horizontal," "vertical," "upward," "downward," "clockwise," and "counterclockwise" merely describe the configuration shown in the drawings. Indeed, the referenced components may be oriented in any direction and the terminology, therefore, should be understood as encompassing such variations unless specified otherwise. For purposes of clarity, the same reference numbers may be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

A window assembly includes a pair of sashes that slide in parallel planes relative to one another, either vertically or horizontally. In the embodiment of the invention described herein, and for exemplary purposes only, a vertically-sliding window sash is described and shown in the Figures; i.e., references to direction of movement up and down are with respect to a vertically-sliding window sash. The sash lock mechanism of the present invention is attached to the adjacent sash portions and includes a first lock portion comprising a linearly depressible trigger, a cam-style locking element, a rotatable detent actuated by the trigger for retaining the locking element in a retracted position, and a transfer element between the detent and the locking element for accommodating multiple lock states when the window sash is closed, all mounted on a first sash. The locking element is normally biased, such as by a spring, into the extended position, but is held in a retracted position when the window is open by a catch portion of the rotatable detent which engages with radially-extending flanges on the perimeter of the body portion of the locking element. Depending on the position of the trigger (extended or retracted), the locking element moves in a direction normal to the planes of the sashes, toward and away from the adjacent sash. A second lock portion is mounted on the adjacent sash and includes a strike having an opening for receiving a portion of the locking element when in the extended or locked position to lock the sashes from relative sliding movement.

An actuator, such as a pull-back pinion or a push-in rack, can be used to engage the locking element and manually switch between locked and unlocked positions. The actuator can be in one of three positions.—1) fully forward or extended, 2) back or partially retracted, or 3) fully back or retracted—depending on the state of the lock. The fully forward or extended position allows the locking element to engage the opposing strike. The back or partially retracted position retracts the locking element. The fully back or retracted position disengages the activated trigger, while the locking element remains retracted, to allow for manually unlocking and opening the window sash from a closed position.

The present invention accommodates three states or phases of the locking mechanism to give a true indication of the state of the lock: 1) window locked and closed; 2) window unlocked and closed; and 3) window unlocked and open. An advantage of the lock mechanism of the present invention is that it allows for the cover to be in a fixed position for each state the lock can be in. As will be described further below, the mechanical cooperation between the linear trigger and rotatable detent of the present invention provides for automated locking of the window sash when the window is moved to a closed position, while the transfer element permits the locking element to return to and remain in the retracted position when the window is closed to allow for manual unlocking of the locking mechanism. Conversely, the locking element is allowed to extend and fire into an opening in the opposing strike when the trigger is depressed as the window is closed.

Referring now to FIGS. 1-8, an embodiment of the automated sash lock 100 of the present invention is shown. Sash lock 100 is mountable on a first window sash (not shown) as part of a window assembly comprising a pair of sashes that slide in parallel planes relative to one another, either vertically or horizontally. In the embodiment of the invention described herein, and for exemplary purposes only, a vertically-sliding window sash is described with reference to the Figures; however, it should be understood by those skilled in the art that the sash lock of the present invention is also applicable to horizontally-oriented sliding window sashes. Sash lock 100 comprises a linearly depressible trigger 10, a cam-style locking element 30, a rotatable detent 20 actuated by the trigger for moving the locking element between unlocked and locked positions, and a transfer element 40 between the detent and the locking element for accommodating the three phases or states of the locking mechanism. An actuator 50, such as a pull-back pinion or a push-in rack, can be used to engage the locking element and manually switch between locked and unlocked positions.

Figure 2:
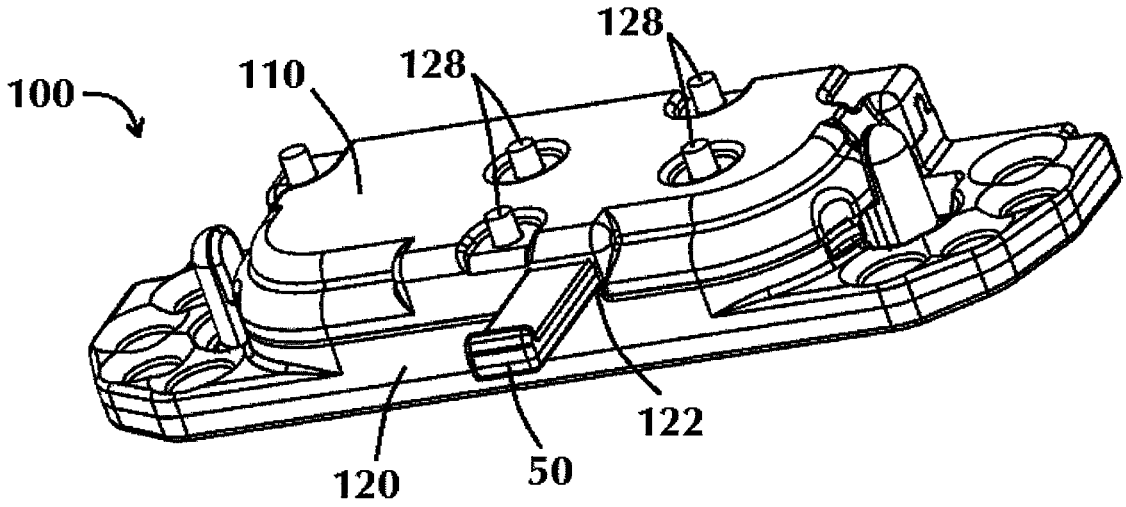
Figure 3:
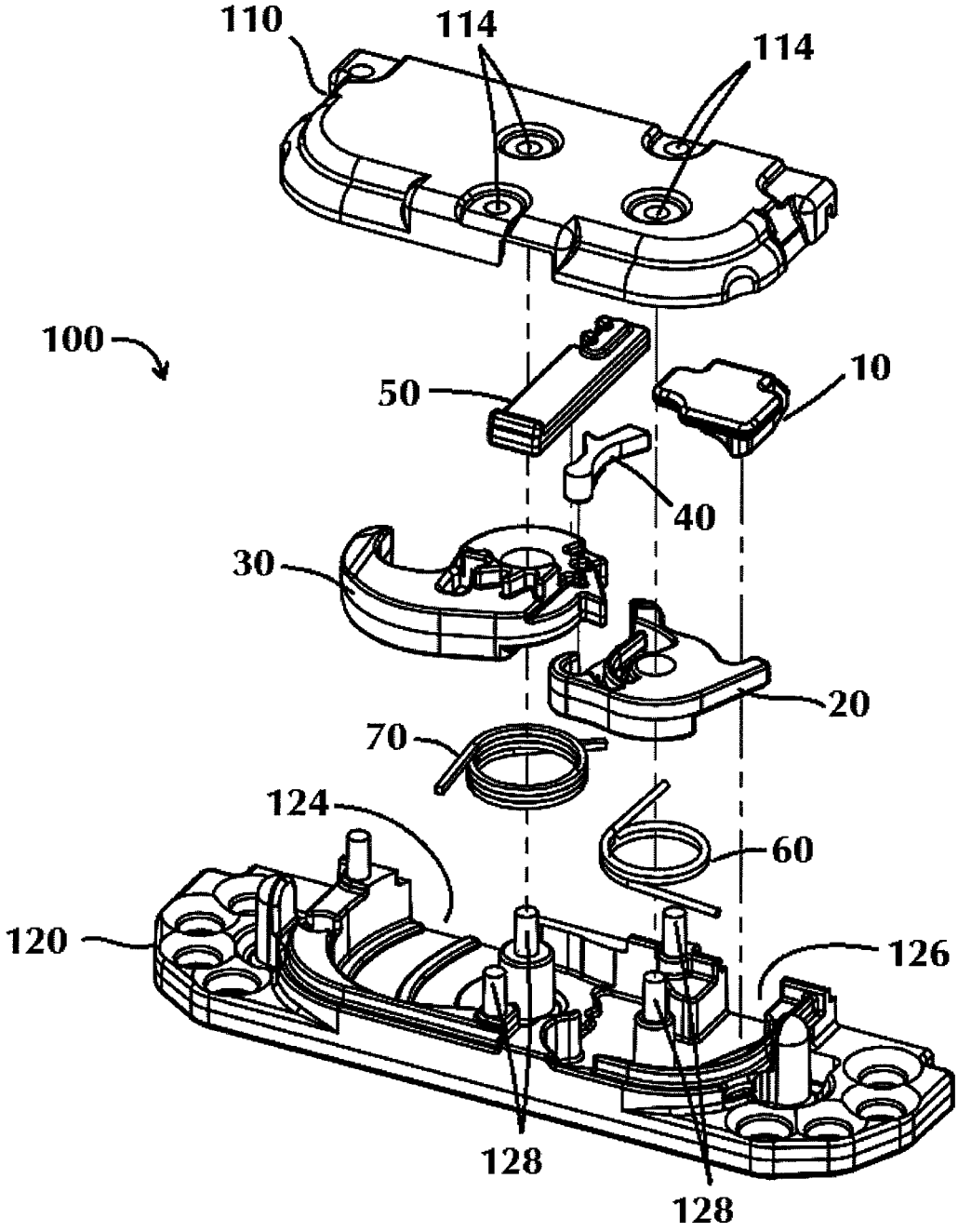
FIG. 3 is an exploded, perspective view of the embodiment of the present invention shown in FIGS. 1-2.

As shown in FIGS. 1-3, the internal sash lock components are generally concealed between upper and lower housing portions 110, 120, which are joined together such as by snap fit. Lower housing or base portion 120 includes a plurality of posts 128 which extend through apertures 114 in upper housing or cover portion 110 when the housing portions are joined together. The sash lock housing further includes front and rear surfaces defining a plurality of formed openings 122, 124, 126 for allowing the interior lock components to extend from and retract into the lock housing during the three phases or states of the locking mechanism. Specifically, push-in rack or actuator 50 is positioned for linear translation within opening 122 in the front surface of the lock housing, and locking element 30 is positioned for rotational extension and retraction within opening 124, and trigger 10 is positioned for linear translation within opening 126, both on the rear surface of the lock housing.

FIGS. 1 and 2 show perspective views of the sash lock mechanism 100 when the window sash is in a closed and locked position. The window sashes are not shown, for clarity. As best seen in FIG. 1, when the window is closed and locked, locking element 30 is extended outwardly from the lock mechanism housing 110, 120 through recess 124 and into a mating opening in a strike in the opposing sash (not shown) to prevent the sashes from relative sliding movement. As opposed to a conventional locking bolt of the prior art, the cam-style locking element 30 of the present invention eliminates the need for additional connection methods to prevent window separation around the lock once the window is closed and locked, and provides increased resistance to forced entry.

As can be seen in the exploded view of FIG. 3, the sash lock mechanism includes a linearly depressible trigger 10 (more particularly depicted in FIG. 8) which mechanically cooperates with a rotatable detent 20 to allow for automatic actuation of locking element 30 when detent 20 is disengaged. The sash lock of the present invention automatically locks the window assembly when the pair of sashes are brought together, without user intervention. More particularly, as the window approaches a closed position (i.e., downward for a vertically-oriented sash), the bottom edge of the window contacts a ramped portion 11 of trigger 10 and causes a cam action, resulting in the trigger sliding linearly into the lock housing 110, 120, normal to the vertically-closing window sash, to overcome the force of spring 60 and rotate detent 20. Opposite ramped portion 11 is a substantially planar contacting surface 13 which is always in contact with a mating portion of detent 20. Trigger 10 further includes an extended lip 12 which extends above and along a top surface 28 of detent 20 (see FIGS. 5 and 18). In contrast to triggers of window assemblies of the prior art, the trigger 10 of the present invention is always in contact with a portion of detent 20 and does not rotate about any axis. Instead, the trigger 10 slides linearly within the lock housing along a plane perpendicular to the movement of the closing sash as a result of the cam action caused by actuation by the closing window sash onto the ramped portion 11 of the trigger.

Figure 4:
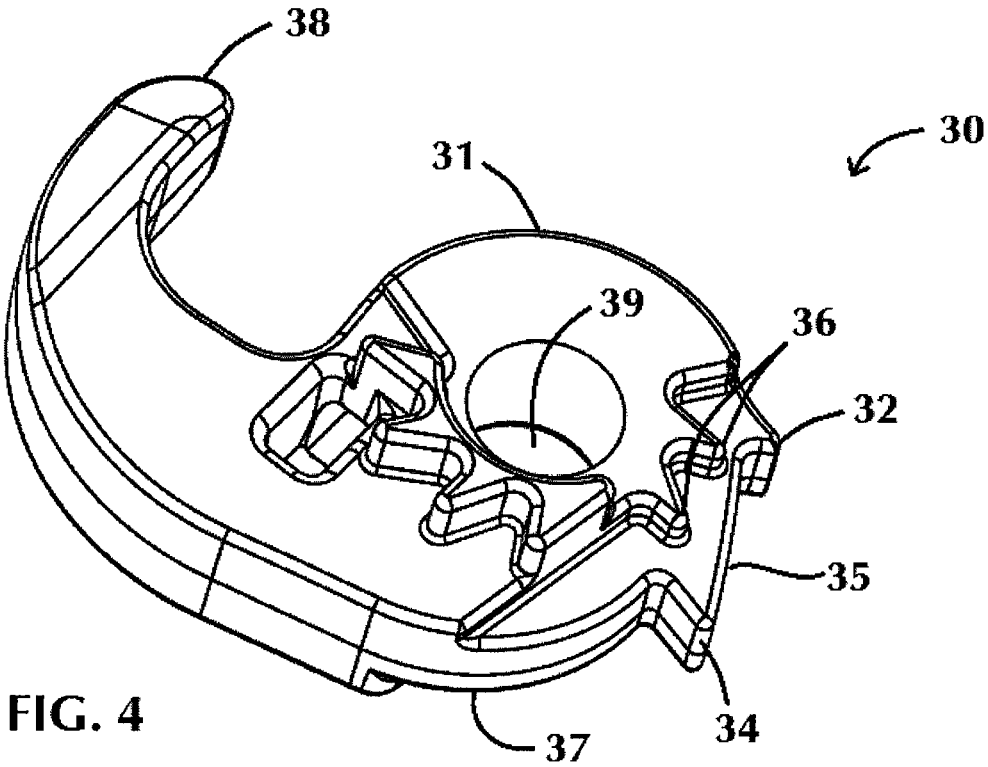
FIGS. 4 to 8 are isolated, perspective views of the locking element, rotatable detent, transfer element, actuator, and trigger, respectively, shown in FIG. 3.
Figure 5:
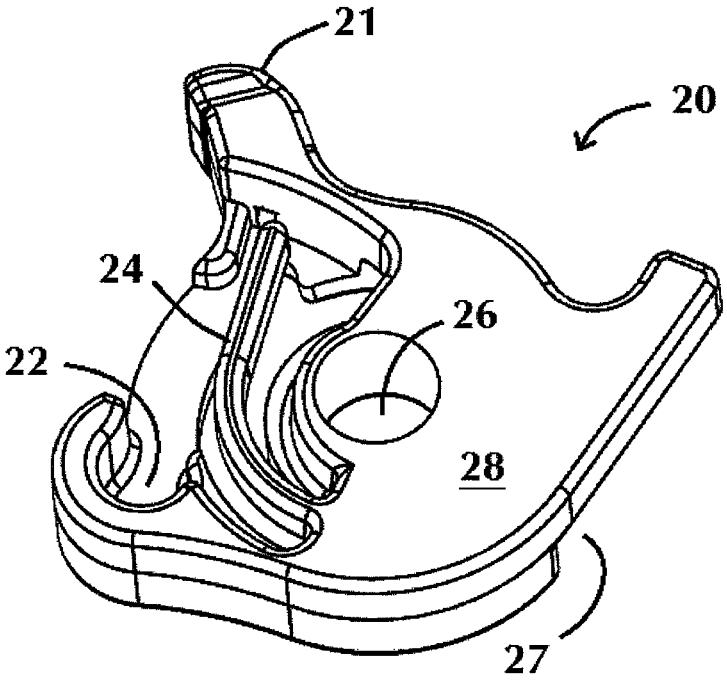
Figure 6:
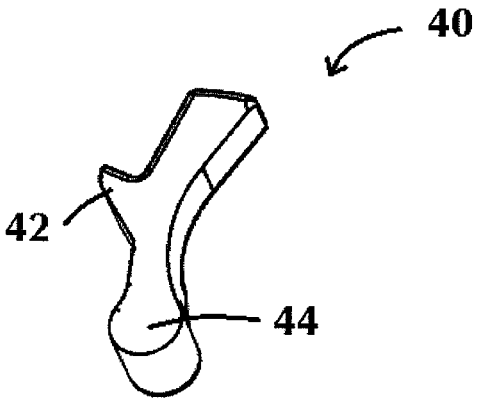
Figure 7:
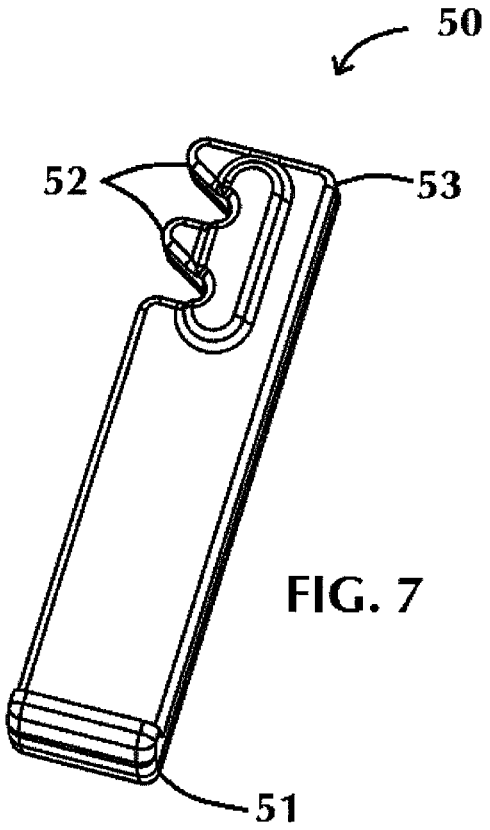
Figure 8:
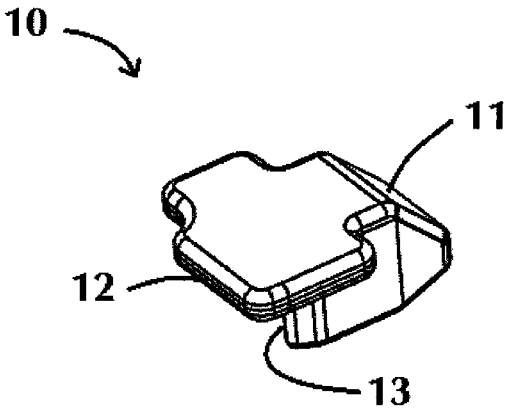
Figure 9:
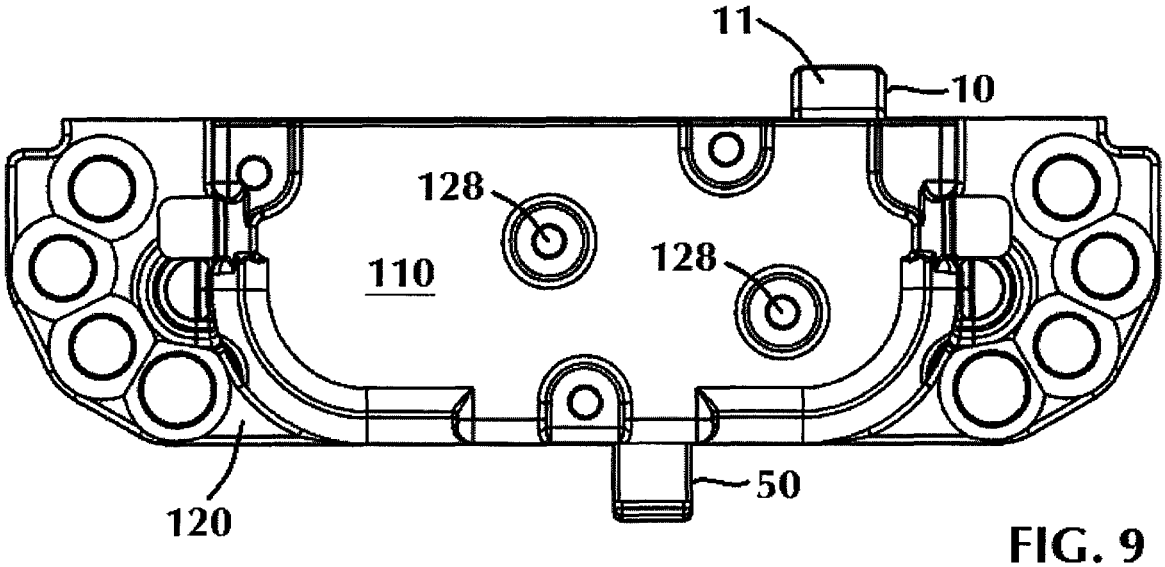
FIGS. 9 and 10 are top plan views of the embodiment of the sash lock mechanism of the present invention shown in FIGS. 1-3, in a window open and unlocked position. The window sashes are not shown, for clarity, and the upper portion of the lock housing has been removed in FIG. 10 to depict the position of the internal sash lock components.
Figure 10:
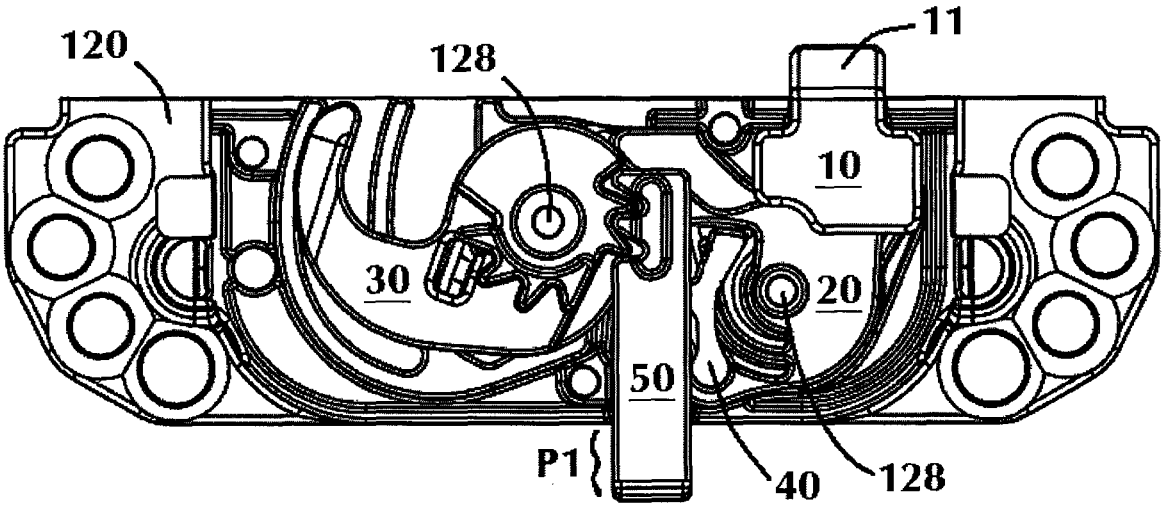

As shown in FIG. 4, locking element 30 includes a body portion 31 with a cam-style hooked portion 38 extending from the body portion, and is normally biased by a spring 70, such as a torsion spring positioned within spring recess 37, into the extended position, but is held in a retracted position (i.e., within the lock housing 110, 120) when the window is open by a catch portion 21 of rotatable detent 20 (FIG. 5) which engages first or second flanges 32, 34 radially extending from the perimeter of the locking element body 31 on a first plane. Locking element 30 further includes a plurality of teeth 36 extending radially from the body portion 31 on a second plane parallel to the first plane and inset from the first and second flanges 32, 34. Depending on the position of the trigger 10 and actuator 50 (one or both extended or retracted), as will be described below, the locking element 30 is caused to rotate about a first axis in a direction normal to the planes of the sashes, toward and away from the adjacent sash. A strike (not shown) is mounted on the adjacent sash and includes an opening for receiving the locking element 30 to lock the sashes from relative sliding movement.

Trigger 10 rotates the detent 20 into the disengaged position when the trigger is actuated by the closing window. When the trigger is deactivated and protruding from the lock housing or cover, as shown in the window open and unlocked state of FIGS. 9-11, the detent 20 is in the engaged position with respect to locking element 30 to maintain the locking element in the unlocked or retracted position. In one embodiment, as described in more detail below, moving an actuator or push rack 50 into the fully back or retracted position P3 will switch the detent 20 from a disengaged to an engaged position, which deactivates the trigger 10 and causes it to extend outside the lock mechanism housing 110, 120, so long as the window is open. It should be understood by those skilled in the art that an actuator such as a push rack extending from the lock housing is only one means of manually switching the detent from a disengaged to an engaged position, and that other manually actuable switching mechanisms may be employed, such as a pullback pinion.

Figure 11:
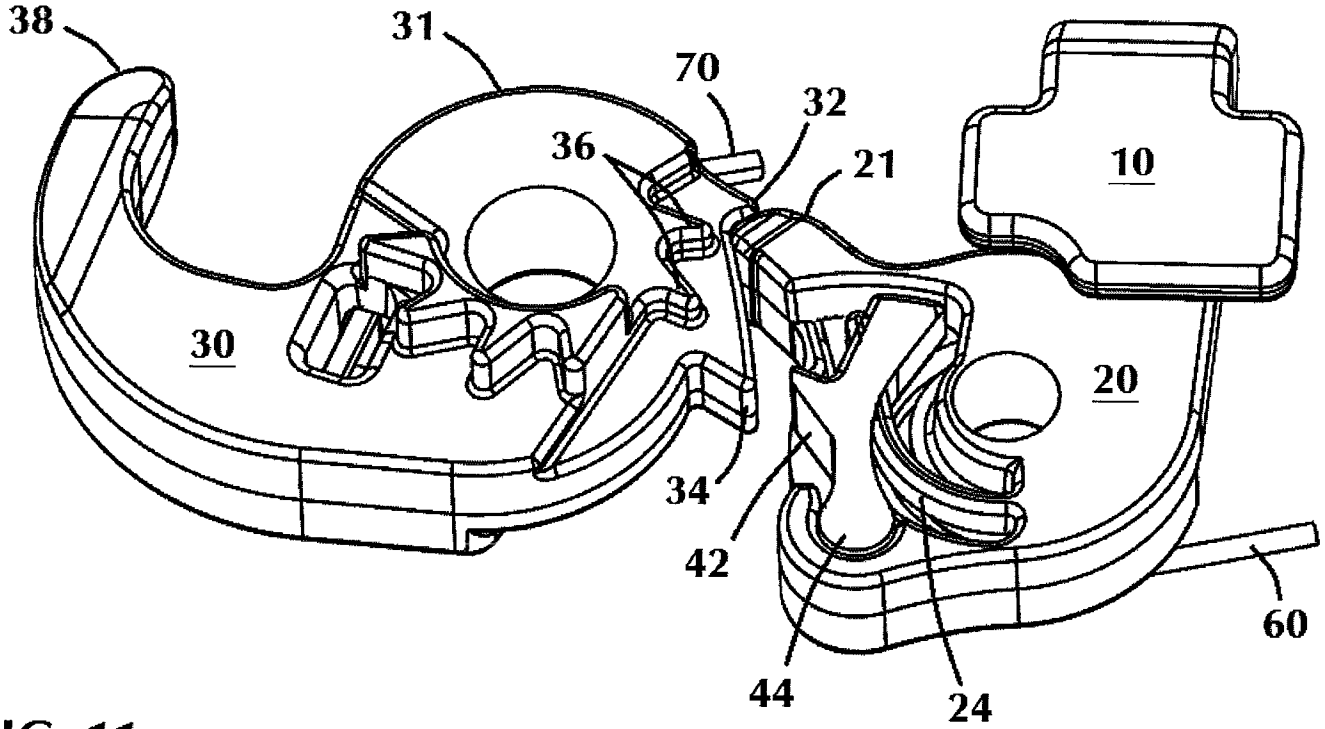
FIG. 11 is an isolated, perspective view of the positions of the trigger, detent, transfer, and locking element, respectively, when the locking mechanism is in the window open and unlocked position, as shown in FIG. 10. The actuator for manually unlocking the sash lock mechanism is not shown, for clarity.
Figure 12:
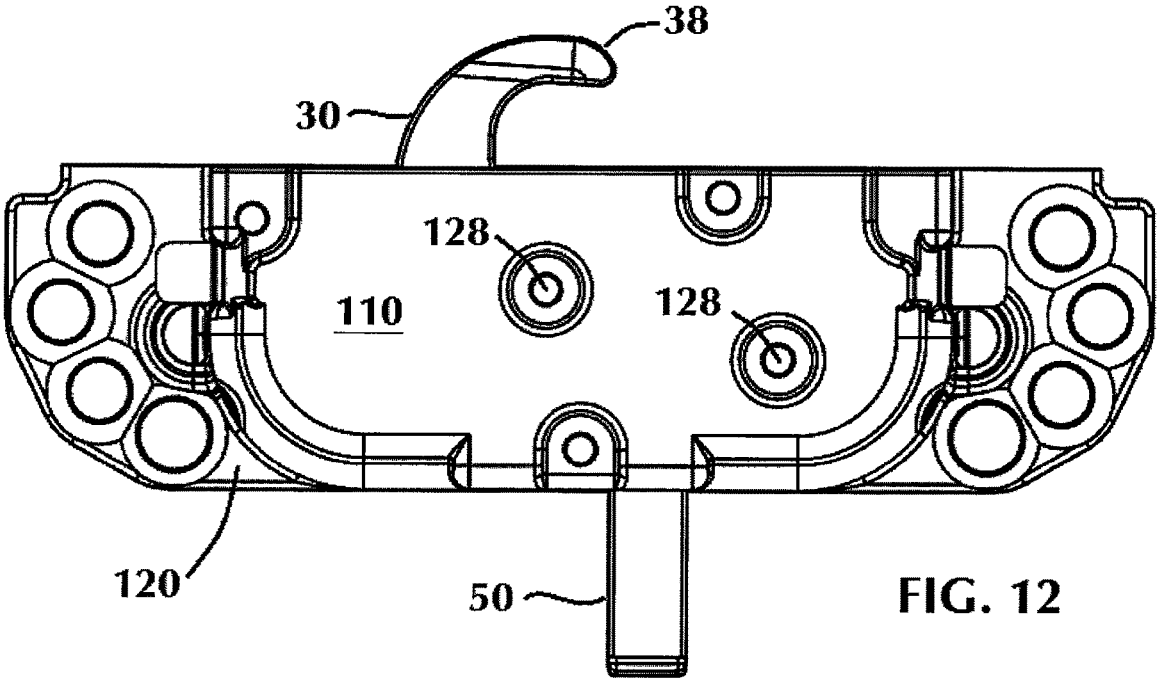
FIGS. 12 and 13 are top plan views of the embodiment of the sash lock mechanism of the present invention shown in FIGS. 1-3, in a window closed and locked position. The window sashes are not shown, for clarity, and the upper portion of the lock housing has been removed in FIG. 13 to depict the position of the internal sash lock components.
Figure 13:
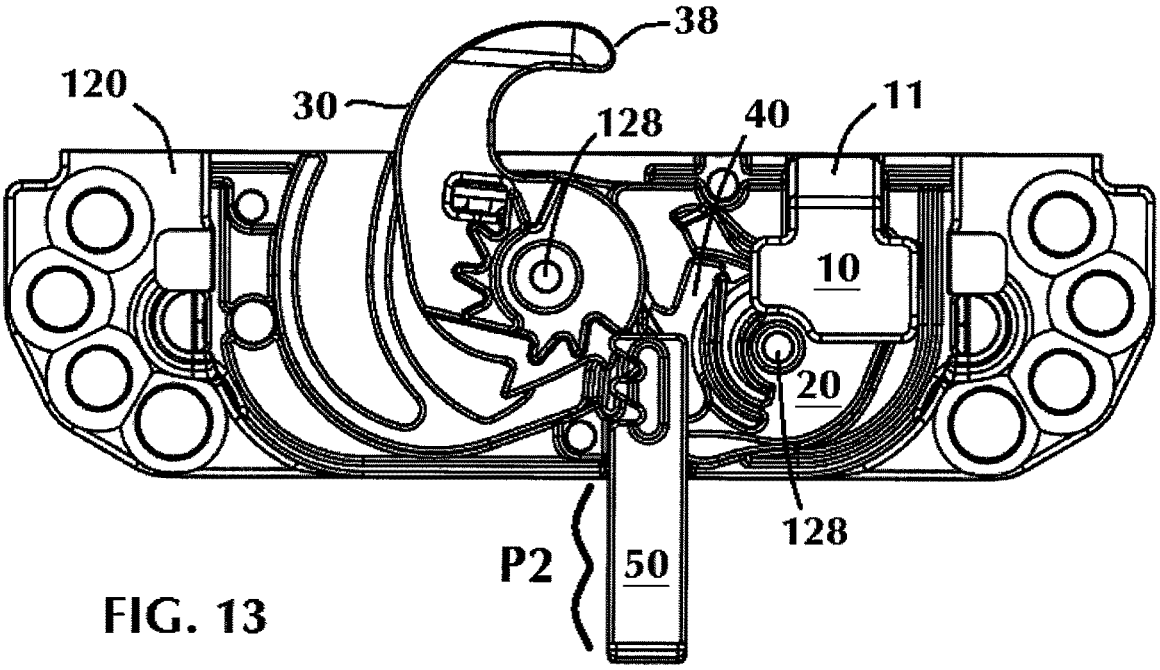
Figure 14:
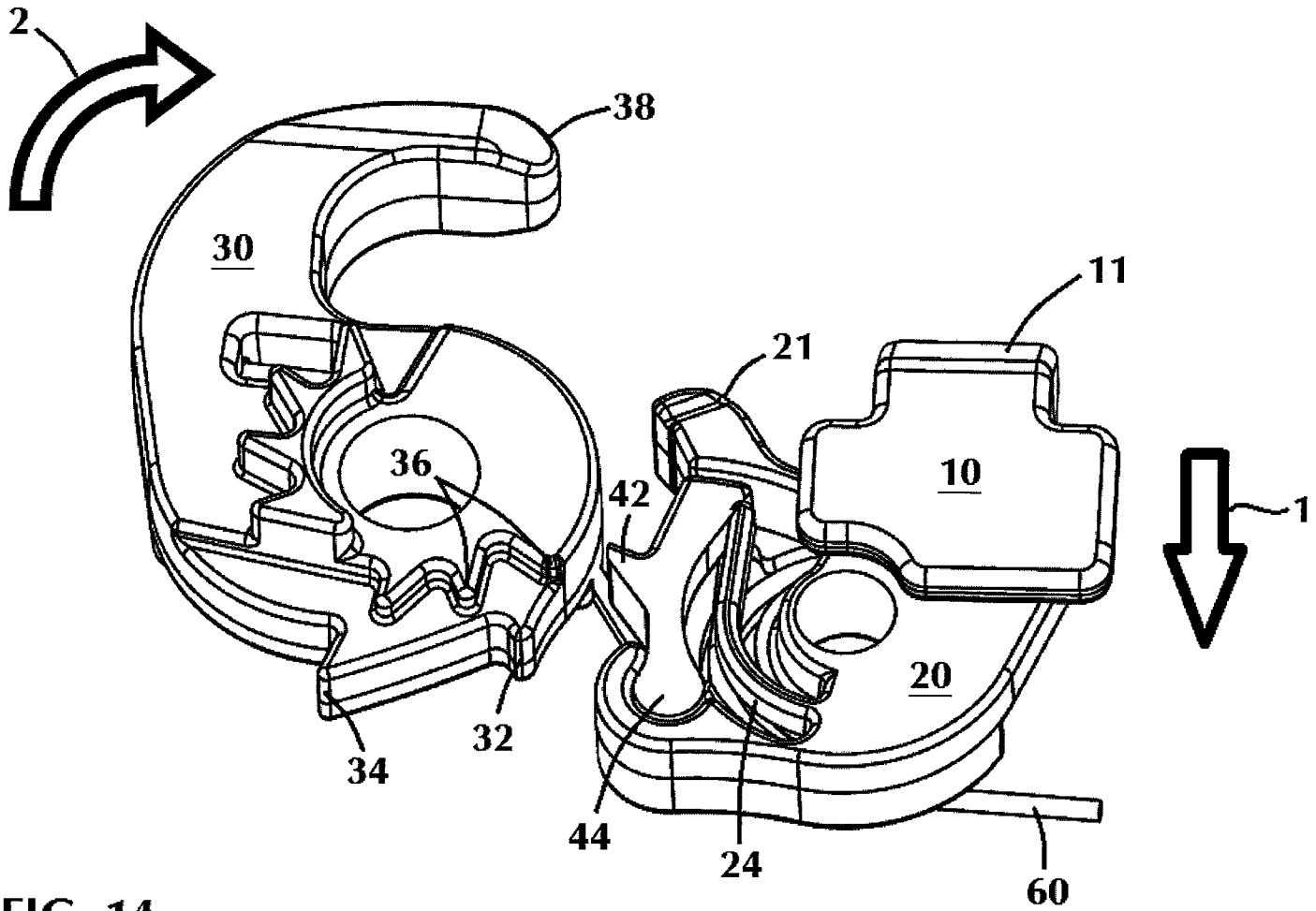
FIG. 14 is an isolated, perspective view of the positions of the trigger, detent, transfer, and locking element, respectively, when the locking mechanism is in the window closed and locked position, as shown in FIG. 13. The actuator for manually unlocking the sash lock mechanism is not shown, for clarity.
Figure 17:
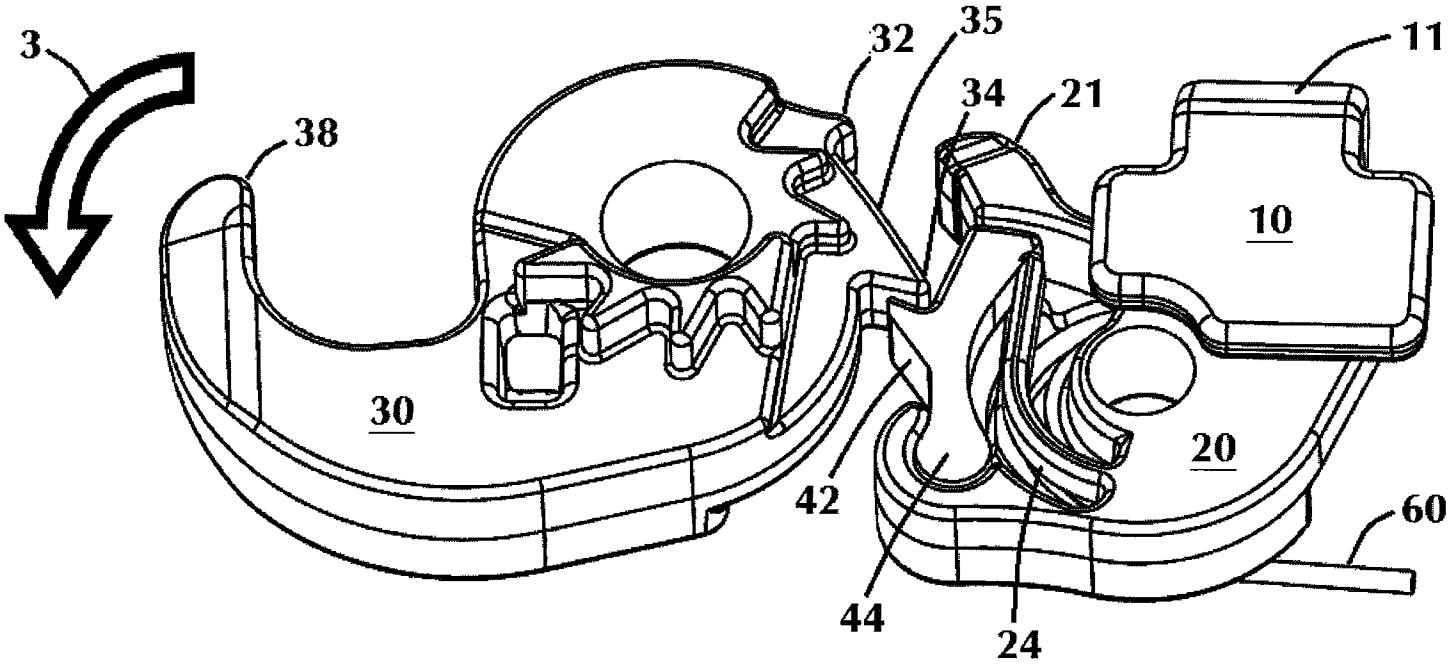
FIG. 17 is an isolated, perspective view of the positions of the trigger, detent, transfer, and locking element, respectively, when the locking mechanism is in the window closed and unlocked position, as shown in FIG. 16. The actuator for manually unlocking the sash lock mechanism is not shown, for clarity.

As shown in FIG. 11, a transfer element 40 having a fin 42 extending from the body of the transfer element is partially disposed within a recessed portion 22 of rotatable detent 20 and is pivotable about a first end 44 as a result of biasing by resilient flange 24 of detent 20. When the detent 20 is in the engaged position, the transfer 40 is in the disengaged position, i.e., not contacting the locking element, as shown in FIG. 11. When the trigger 10 is actuated by a closing window, the trigger translates linearly into the lock housing and rotates the detent 20 into the disengaged position, pulling the detent 20 and transfer 40 away from locking element 30 and allowing hook 30 to fire out of the sash lock mechanism to engage the opposing sash (FIGS. 12-14). Conversely, when the detent 20 is disengaged, and actuator or push rack 50 is in the fully back or retracted position P3, the transfer fin 42 becomes engaged with the locking element and holds it in the unlocked or retracted position (FIG. 17). When actuator or push rack 50 is in the back or retracted position P1 (detent 20 still being disengaged), the transfer 40 is positioned to allow for locking element engagement with the adjacent sash to prevent the sashes from relative sliding movement.

Detent 20 is normally biased by a spring 60, such as a torsion spring positioned within spring recess 27, toward the locking element 30, such that a catch 21 of the detent engages with a first flange 32 of the body portion of the locking element, maintaining the locking element in a retracted position, as shown in FIG. 11. Detent 20 rotates about an axis parallel to the axis of rotation of locking element 30, and normally biases trigger 10 into the extended position. As the window is closed, trigger 10 overcomes the force of spring 60 to slide linearly into the lock housing during actuation as a result of the closing window, and the trigger biases the detent 20 in a direction opposite its normal operation and causes the detent to counter-rotate (clockwise, as shown in FIG. 14), pulling the catch 21 of the detent away from the first flange 32 of the locking element and allowing the locking hook 38 to fire outwardly into the strike opening in the adjacent sash (not shown), thereby locking the sashes from relative movement.

Referring now to FIGS. 12-14, the window locked and closed state is shown in more detail. As shown in FIG. 12, when the window is closed and locked, locking element 30 is extended outwardly from the lock mechanism housing 110, 120 and into an opening in a strike in the opposing sash (not shown) to prevent the sashes from relative sliding movement. As opposed to a conventional locking bolt of the prior art, the cam-style locking element of the present invention eliminates the need for additional connection methods to prevent window separation around the lock once the window is closed and locked, and provides increased resistance to forced entry.

As best seen in FIG. 14, detent 20 has been counter-rotated in a clockwise direction by the linear movement of trigger 10 in the direction of arrow 1, pulling the detent and transfer 40 away from the locking element and allowing the locking element 30 to fire outwardly into the extended position in the direction of arrow 2. Catch 21 of the detent is disengaged from first flange 32 of the body portion of the locking element, and detent fin 42 is also disengaged, allowing spring 70 to bias locking element 30 into the extended or locked position. The rotation of locking element 30 further causes push-in rack 50 to move to the extended position P2 (FIG. 13).

Figure 15:
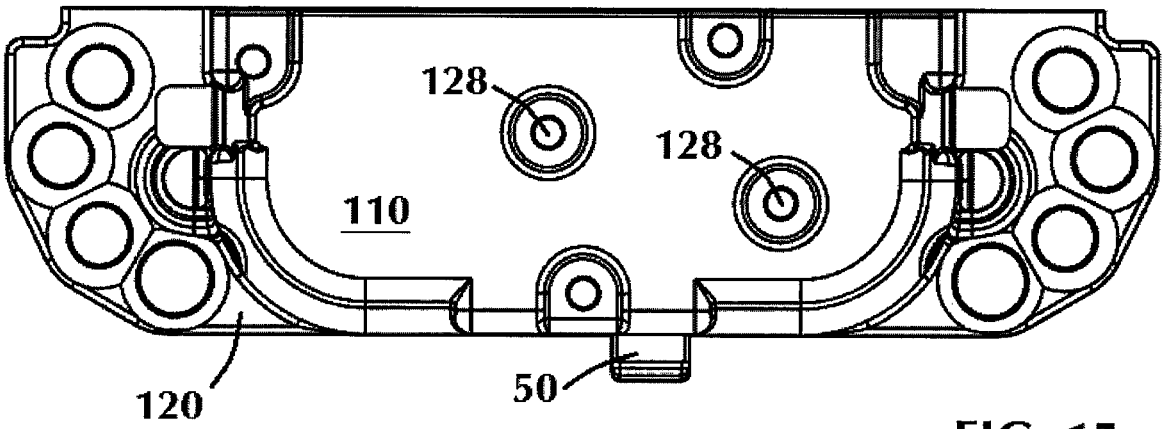
FIGS. 15 and 16 are top plan views of the embodiment of the sash lock mechanism of the present invention shown in FIGS. 1-3, in a window closed and unlocked position. The window sashes are not shown, for clarity, and the upper portion of the lock housing has been removed in FIG. 16 to depict the position of the internal sash lock components.
Figure 16:
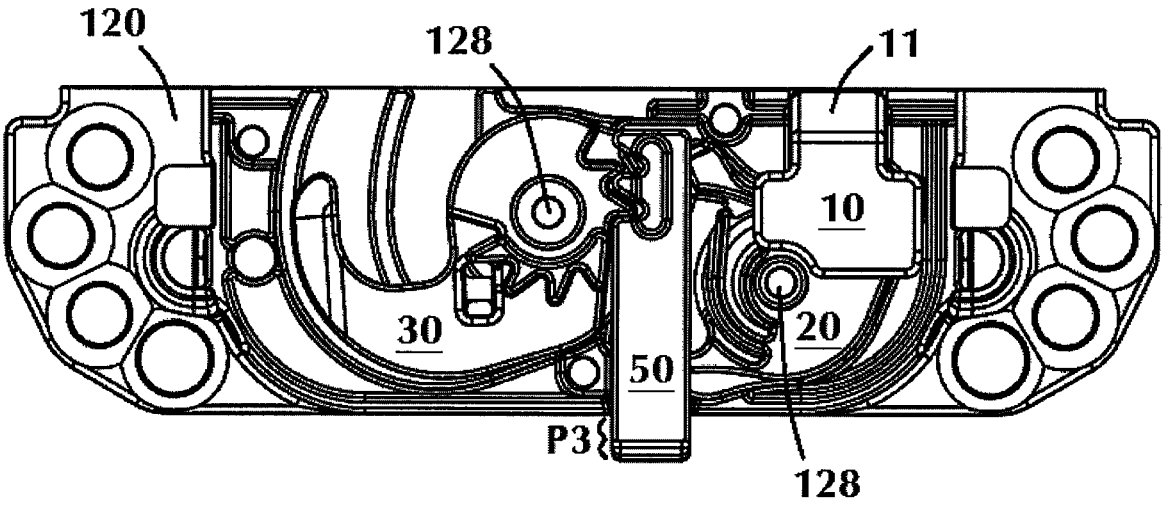

Subsequent to the window closing (and the lock mechanism automatically locking the sashes), a user can manually unlock the locking mechanism via actuator or push-in rack 50. FIGS. 15-17 depict the locking mechanism of the present invention in a window closed and unlocked state. As shown in FIG. 16, push-in rack 50 has been manually actuated and is in the transfer or fully-retracted position P3 within the lock housing 110, 120. As push-in rack 50 traverses linearly into the lock housing, teeth 52 adjacent the distal end 53 of push-in rack 50 engage the teeth 36 on the body portion 31 of locking element 30, causing the locking element to rotate counterclockwise into the retracted or unlocked position (as shown from the transition between FIG. 14 and FIG. 17). Trigger 10 remains in a depressed or retracted position as a result of the window remaining closed. Because trigger 10 remains depressed, detent 20 remains in the disengaged or retracted position. However, as best seen in FIG. 17, transfer 40 acts as a pawl and fin 42 is now engaged with locking element 30, holding the locking element in the unlocked or retracted position. As locking element 30 rotates in a counterclockwise direction (as shown by arrow 3), resilient member or flange 24 of the detent 20 biases transfer fin 42 towards flange 34 of the locking element 30, retaining the locking element in the retracted position as fin 42 clears the outwardly angled face 35 of flange 34.

Referring again to FIGS. 9-11, when the window is next opened, trigger 10 (which is normally biased outwardly by spring 60) translates linearly into the extended position, allowing detent 20 (which is normally biased towards the locking element) to rotate counterclockwise to the engaged position, causing the detent catch 21 to engage with first flange 32 of the body portion of the locking element. Locking element 30 is thus held in the unlocked position by the mechanical communication between detent catch 21 and locking element flange 32, and the transfer member 40 and fin 42 are in the disengaged position. From this open and unlocked state, the locking mechanism is again ready for automated locking once the window sash is moved toward the closed position, causing linear actuation of the trigger 10 and rotation of detent 20 away from the locking element 30.

Figure 18:
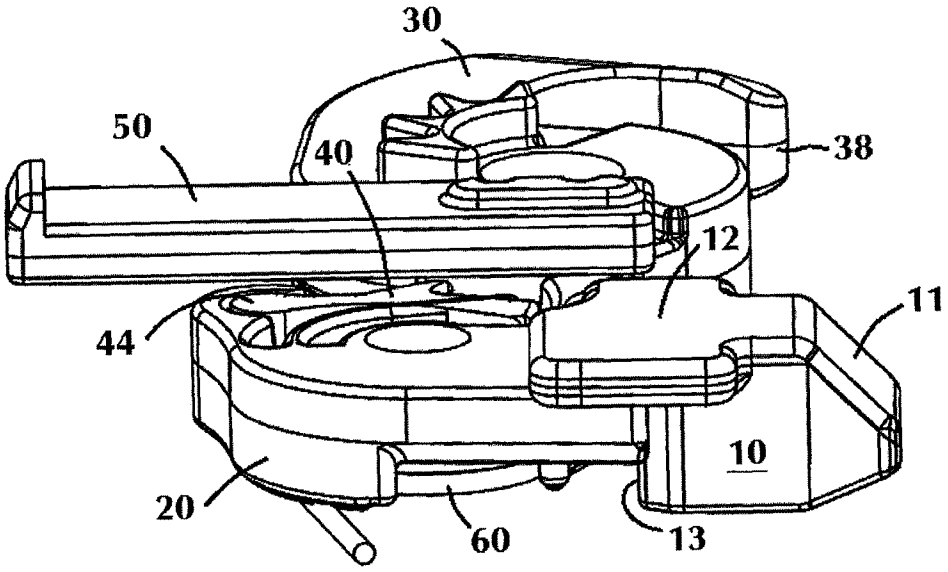
FIGS. 18 and 19 are side, isolated plan views of the embodiment of the sash lock mechanism of the present invention shown in FIGS. 1-3, as the sash lock mechanism transitions from a window open and unlocked position to a window closed and locked position.
Figure 19:
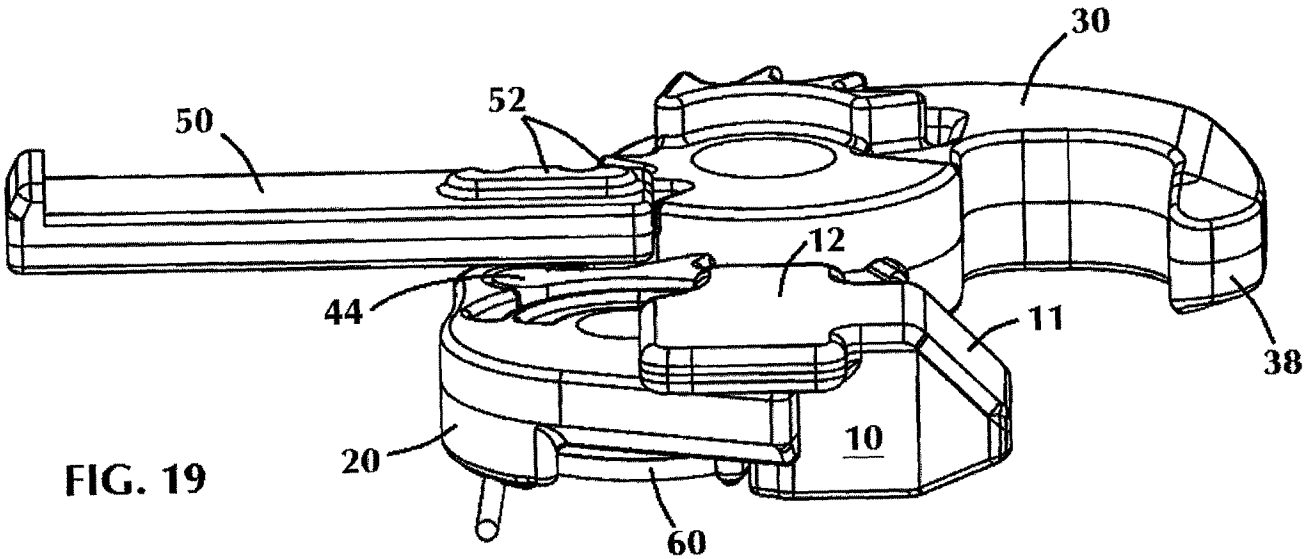

FIGS. 18-19 depict the positions of the interior sash lock components as the lock mechanism transitions from a window open and unlocked position (FIG. 18) to a window closed and locked position (FIG. 19). As shown by the transition from FIG. 18 to FIG. 19, as trigger 10 translates linearly into the lock housing (not shown) as a result of the closing window sash, detent 20 is caused to rotate in a clockwise direction, pulling detent 20 and transfer 40 away from the locking element 30 and allowing the locking element 30 to fire outwardly, i.e., rotate, into the extended or locked position. The rotation of locking element 30 further causes push-in rack 50 to move to the extended position, as shown in FIG. 19.

Thus the present invention achieves one or more of the following advantages. The present invention provides an improved window sash lock that automatically locks the window sashes without user intervention. The present invention further provides a true indication of the state of the lock and can accommodate multiple lock states, and does not require additional connection methods to prevent window separation around the lock once the window is locked.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

The invention claimed is:

1. An automated sash lock for locking a window sash, comprising:

a lock housing having a front surface and a rear surface defining first and second openings;

a locking element comprising a body portion and a cam portion extending from the body portion, the locking element being rotatable through the rear surface first opening about a first axis between unlocked and locked positions, the locking element being normally biased toward the locked position;

a detent rotatably secured within the lock housing and rotatable between engaged and disengaged positions about a second axis parallel to the first axis, the detent engaged with the locking element body portion when in the engaged position to retain the locking element in the unlocked position, the detent being normally biased toward the engaged position;

a depressible trigger being linearly translatable between an extended position and a retracted position within the lock housing to rotate the detent to the disengaged position, the trigger at least partially extending through the rear surface second opening when in the extended position and being normally biased to the extended position by the detent, wherein the trigger is caused to translate from the extended position to the retracted position as the window sash moves into a window closed position, thereby rotating the detent into the disengaged position and causing the locking element to move to the locked position, the locking element cam portion engaging with a strike in an adjacent window sash when in the locked position to prevent the sashes from relative sliding movement; and an actuator engageable with the locking element body portion and translatable through an opening in the lock housing front surface between first, second, and third positions, the actuator being in the first position when the locking element is in the unlocked position and the detent is in the engaged position and being in the second position when the locking element is in the locked position and the detent is in the disengaged position, the actuator being manually translatable to the third position when the locking element is in the locked position and the detent is in the disengaged position to cause the locking element to rotate to the unlocked position.

2. The sash lock of claim 1 further including a transfer element pivotally secured within the lock housing and pivotable between first and second positions about a first end, the transfer element including a fin for engaging the locking element body portion to retain the locking element in an unlocked position when the transfer element is in the first position and the detent is in the disengaged position.

3. The sash lock of claim 2 wherein the detent includes a recess and a resilient flange adjacent the recess, and wherein the transfer element is at least partially disposed within the detent recess, the transfer element being normally biased toward the first position by the detent resilient flange.

4. The sash lock of claim 2 wherein the locking element body portion includes first and second flanges extending radially therefrom, the transfer element fin engaging the locking element second flange when the transfer element is in the first position and the locking element is in the unlocked position.

5. The sash lock of claim 4 wherein the detent has a catch extending therefrom, the detent catch being engaged with the locking element first flange when the detent is in the engaged position.

6. The sash lock of claim 1 wherein the locking element body portion includes a plurality of teeth extending radially therefrom and the actuator is engageable with the locking element plurality of teeth, the engagement between the actuator and the locking element plurality of teeth causing the locking element to rotate to the unlocked position as the actuator is manually translated to the third position.

7. The sash lock of claim 1 wherein the actuator first position represents a window open and unlocked state, the second position represents a window closed and locked state, and the third position represents a window closed and unlocked state.

8. The sash lock of claim 1 wherein the actuator comprises a push rack extending through the front surface opening.

9. The sash lock of claim 8 wherein at least a portion of the actuator is visible when the actuator is in the first, second, and third positions to indicate a state of the sash lock.

10. The sash lock of claim 1 wherein the trigger includes a ramped portion for slidingly contacting an edge of the window sash as the window moves into the window closed position, whereby the window sash edge causes a cam action to translate the trigger into the retracted position.

11. The sash lock of claim 1 wherein the locking element cam portion comprises a hooked portion extending radially from the body portion for engaging with the strike in the adjacent window sash when in the locked position.

12. The sash lock of claim 1 wherein the trigger is linearly translatable in a direction normal to the first and second axes.

13. An automated sash lock for locking a window sash, comprising:

a lock housing having a front surface and a rear surface defining first and second openings;

a locking element comprising a body portion and a cam portion extending from the body portion, the locking element being rotatable through the rear surface first opening about a first axis between unlocked and locked positions, the locking element being normally biased toward the locked position;

a detent rotatably secured within the lock housing and rotatable between engaged and disengaged positions about a second axis parallel to the first axis, the detent engaged with the locking element body portion when in the engaged position to retain the locking element in the unlocked position, the detent being normally biased toward the engaged position;

a transfer element pivotally secured within the lock housing and pivotable between first and second positions about a first end, the transfer element including a fin for engaging the locking element body portion to retain the locking element in an unlocked position when the transfer element is in the first position and the detent is in the disengaged position; and a depressible trigger being linearly translatable between an extended position and a retracted position within the lock housing to rotate the detent to the disengaged position, the trigger at least partially extending through the rear surface second opening when in the extended position and being normally biased to the extended position by the detent, wherein the trigger is caused to translate from the extended position to the retracted position as the window sash moves into a window closed position, thereby rotating the detent into the disengaged position and causing the locking element to move to the locked position, the locking element cam portion engaging with a strike in an adjacent window sash when in the locked position to prevent the sashes from relative sliding movement.

14. The sash lock of claim 13 wherein the detent includes a recess and a resilient flange adjacent the recess, and wherein the transfer element is at least partially disposed within the detent recess, the transfer element being normally biased toward the first position by the detent resilient flange.

15. The sash lock of claim 13 wherein the lock housing front surface defines an opening and further including an actuator engageable with the locking element body portion and translatable through the front surface opening between first, second, and third positions, the actuator being in the first position when the locking element is in the unlocked position and the detent is in the engaged position and being in the second position when the locking element is in the locked position and the detent is in the disengaged position, the actuator being manually translatable to the third position when the locking element is in the locked position and the detent is in the disengaged position to cause the locking element to rotate to the unlocked position.

16. A method of operating a sash lock mounted with respect to window sashes capable of relative sliding movement, comprising:

providing a sash lock mounted on a first window sash, the sash lock including:

a lock housing having a front surface and a rear surface defining first and second openings;

a locking element comprising a body portion and a cam portion extending from the body portion, the locking element being rotatable through the rear surface first opening about a first axis between unlocked and locked positions, the locking element being normally biased toward the locked position;

a detent rotatably secured within the lock housing and rotatable between engaged and disengaged positions about a second axis parallel to the first axis, the detent engaged with the locking element body portion when in the engaged position to retain the locking element in the unlocked position, the detent being normally biased toward the engaged position;

a depressible trigger being linearly translatable between an extended position and a retracted position within the lock housing to rotate the detent to the disengaged position, the trigger at least partially extending through the rear surface second opening when in the extended position and being normally biased to the extended position by the detent; and a transfer element pivotally secured within the lock housing and pivotable between first and second positions about a first end, the transfer element including a fin for engaging the locking element body portion to retain the locking element in an unlocked position when the transfer element is in the first position and the detent is in the disengaged position;

providing a strike mounted on a second window sash, the strike including an opening for receiving the locking element and preventing the sashes from relative sliding movement;

causing the detent to rotate to the engaged position to retain the locking element in the unlocked position;

moving the first window sash with respect to the second window sash from an open position towards a closed position wherein the window sashes move relative to each other in generally parallel planes; and causing the trigger to translate from the extended position to the retracted position as the window sashes move into the closed position, thereby rotating the detent into the disengaged position and causing the locking element to rotate to the locked position, the locking element cam portion engaging with the strike opening to prevent the sashes from relative sliding movement.

17. The method of claim 16 wherein the sash lock further includes:

an actuator engageable with the locking element body portion and translatable through an opening in the lock housing front surface between first, second, and third positions, the actuator being in the first position when the locking element is in the unlocked position and the detent is in the engaged position and being in the second position when the locking element is in the locked position and the detent is in the disengaged position, the actuator being manually translatable to the third position when the locking element is in the locked position and the detent is in the disengaged position, the method further comprising:

translating the actuator to the third position to cause the locking element to rotate to the unlocked position, engagement between the actuator and the locking element body portion causing the locking element to rotate to the unlocked position as the actuator is translated to the third position; and causing the transfer element to pivot from the second position to the first position to retain the locking element in the unlocked position.

18. The method of claim 17 wherein at least a portion of the actuator is visible when the actuator is in the first, second, and third positions to indicate a state of the sash lock, the method further comprising:

viewing a position of the actuator to determine whether the sash lock is in a locked or unlocked condition when the window sashes are in the closed position.

* * * * *